US011581177B2

(12) United States Patent
Stephan et al.

(10) Patent No.: US 11,581,177 B2
(45) Date of Patent: Feb. 14, 2023

(54) SYSTEM FOR INTRODUCING PARTICLE-CONTAINING SAMPLES TO AN ANALYTICAL INSTRUMENT AND METHODS OF USE

(71) Applicants: PerkinElmer Health Sciences Canada, Inc., Woodbridge (CA); Perkin Elmer Yuhan Hoesa, Seoul (KR)

(72) Inventors: Chady Stephan, Brampton (CA); Chung Ryu, Waltham, MA (US)

(73) Assignees: PerkinElmer Health Sciences Canada, Inc., Woodbridge (CA); Perkin Elmer Yuhan Hoesa, Seoul (KR)

( * ) Notice: Subject to any disclaimer, the term of this patent is extended or adjusted under 35 U.S.C. 154(b) by 708 days.

(21) Appl. No.: 16/519,925

(22) Filed: Jul. 23, 2019

(65) Prior Publication Data

US 2020/0035475 A1 Jan. 30, 2020

Related U.S. Application Data

(60) Provisional application No. 62/703,428, filed on Jul. 25, 2018.

(51) Int. Cl.
*H01J 49/04* (2006.01)
*H01J 49/10* (2006.01)

(52) U.S. Cl.
CPC ..... *H01J 49/045* (2013.01); *H01J 49/0422* (2013.01)

(58) Field of Classification Search
CPC .. H01J 49/045; H01J 49/0422; H01J 49/0427; H01J 49/105; H01J 49/0431
See application file for complete search history.

(56) References Cited

U.S. PATENT DOCUMENTS 4,958,529 A * 9/1990 Vestal ..... H01J 49/044 73/864.81
5,477,048 A 12/1995 Nakagawa et al.
8,263,897 B2 * 9/2012 Morrisroe ..... G01N 21/68 219/121.48
10,497,550 B1 * 12/2019 Field ..... H01J 49/0422
2003/0112431 A1 6/2003 Ketkar
2015/0235827 A1 * 8/2015 Bazargan ..... H01J 49/0009 702/116

(Continued)

FOREIGN PATENT DOCUMENTS

CN 103674812 A 3/2014
GB 2512309 A 10/2014

(Continued)

OTHER PUBLICATIONS

Apr. 8, 2022—(EP)—Extended European Search Report—Application 19841829.5.

(Continued)

*Primary Examiner* — Herbert K Roberts
*Assistant Examiner* — Anthony W Megna Fuentes
(74) *Attorney, Agent, or Firm* — Banner & Witcoff, Ltd.

(57) ABSTRACT

Systems and methods for use in introducing samples to an analytical instrument. The systems and methods are adaptable to process either a liquid sample or a gaseous sample, including samples containing particle contaminants, for subsequent analysis using an analytical instrument.

24 Claims, 12 Drawing Sheets

(56) References Cited

U.S. PATENT DOCUMENTS

| | | | |
|---|---|---|---|
| 2017/0140914 | A1 | 5/2017 | Wehrs |
| 2018/0151341 | A1 | 5/2018 | Joos et al. |

FOREIGN PATENT DOCUMENTS

| | | | |
|---|---|---|---|
| JP | H06-096724 | A | 4/1994 |
| TW | 201020537 | A | 6/2010 |

OTHER PUBLICATIONS

Taylor, Howard E., "Chapter 5: Sample Introduction", in "Inductively Coupled Plasma-Mass Spectrometry: Practices and Techniques", Elsevier Science and Technology, Jan. 1, 2001, pp. 53-90.
Peters, Gregory R. and Beauchemint, Diane, "Versatile Interface for Gas Chromatographic Detection or Solution Nebulization Analysis by Inductively Coupled Plasma Mass Spectrometry: Preliminary Results", Journal of Analytical Atomic Spectrometry, vol. 7, No. 6, Sep. 1, 1992, pp. 965-969.
Yang, Jinfu, Conver, Timothy S., Koropchak, John A., and Leighty, David A., "Use of a mutli-tube Nation® membrane dryer for desolvation with thermospray sample introduction to inductively coupled plasma-atomic emission spectrometry", Spectrochemica Acta Part B, 1996, pp. 1491-1503.
Debrah, Ebenezer and Legere, Guy, Improving Sensitivity and Detection Limits in ICP-MS With a Novel High-Effiiciency Sample Introduction System, Atomic Spectroscopy, vol. 20, No. 2, Apr. 1, 1999, pp. 73-77.
Sep. 13, 2019—(WO)—International Search Report and Written Opinion—PCT/CA2019/051020.

* cited by examiner

| Sample | Analyte | Gas Flow Rate (L/min) | Most Freq. Size (nm) | Most Size (nm) | No. of Peaks | Mean Inten. (counts) | Part. Conc. (parts/mL) | Diss. Inten. (counts) | Diss. Conc. (ppb) |
|---|---|---|---|---|---|---|---|---|---|
| Lab Air Na Scan | Na 22.9898 | 0.7 | 132 | 150.6931 | 101 | 88.72277 | 1929.76422 | 2.446543 | 0.52519 |
| Lab Air K Scan | K 38.9637 | 0.7 | 92 | 112.4405 | 949 | 116.9684 | 18132.1411 | 2.934228 | 0.378071 |
| Lab Air Mg Scan | Mg 23.985 | 0.7 | 97 | 111.9623 | 53 | 132.8889 | 1012.64855 | 0.005223 | -0.02662 |
| Lab Air Cu Scan | Cu 62.9298 | 0.7 | 33 | 45.59231 | 130 | 64.12308 | 2483.85494 | 0 | -0.03836 |
| Lab Air Fe Scan | Fe 56.9354 | 0.7 | 88 | 103.5057 | 435 | 44.29078 | 8311.36077 | 0 | -0.36631 |
| Lab Air Zn Scan | Zn 65.926 | 0.7 | 322 | 102.6108 | 835 | 840.4872 | 15953.9914 | 0.063896 | -0.67595 |
| Lab Air Pb Scan | Pb 207.977 | 0.7 | 13 | 23.19069 | 2255 | 40.5122 | 43085.33 | 0.042898 | -0.05695 |
| Lab Air Pb Scan | Pb 207.977 | 0.35 | 8 | 15.63723 | 1053 | 18.18424 | 20119.225 | 0.015453 | -0.05874 |
| Lab Air Zn Scan | Zn 65.926 | 0.35 | 52 | 87.05747 | 174 | 409.1429 | 3324.54431 | 0.018781 | -0.71606 |
| Lab Air Fe Scan | Fe 56.9354 | 0.35 | 53 | 73.17857 | 420 | 32.74419 | 8024.76212 | 0.019224 | -0.22247 |
| Lab Air Cu Scan | Cu 62.9298 | 0.35 | 28 | 40.19512 | 41 | 30.87805 | 783.369636 | 0 | -0.03836 |
| Lab Air Mg Scan | Mg 23.985 | 0.35 | 77 | 85 | 15 | 19.93333 | 286.598647 | 0 | -0.0303 |
| Lab Air K Scan | K 38.9637 | 0.35 | 95 | 108.4047 | 257 | 91.70039 | 4910.39016 | 2.748504 | 0.343808 |
| Lab Air Na Scan | Na 22.9898 | 0.35 | 138 | 138 | 17 | 47.52941 | 324.8118 | 3.121737 | 0.97226 |

FIG. 9

SYSTEM FOR INTRODUCING PARTICLE-CONTAINING SAMPLES TO AN ANALYTICAL INSTRUMENT AND METHODS OF USE

FIELD

Aspects described herein generally relate to systems and methods for use in introducing samples to an analytical instrument, and more particularly to a system adaptable to process either a liquid sample or a gaseous sample, including samples containing particle contaminants, for subsequent analysis by an analytical device/instrument, such as e.g., a mass spectrometer and/or a inductively coupled plasma mass spectrometer.

BACKGROUND

Mass analysis, and more particularly mass spectrometry, is an effective analytical technique for identifying unknown compounds and for determining the precise mass of known compounds. Advantageously, compounds can be detected or analyzed in minute quantities, allowing compounds to be identified at very low concentrations in chemically complex mixtures. Mass spectrometry, including inductively coupled plasma mass spectrometry ("ICP-MS") has found practical application in a variety of fields, including medicine, pharmacology, food sciences, semi-conductor manufacturing, environmental sciences, and security.

A typical mass spectrometer includes an ion source that ionizes particles of interest. Conventional ion sources may, for example, create ions by electrospray or chemical ionization. The ions are passed to an analyzer region, where they are separated according to their mass (m)-to-charge (z) ratios (m/z). The separated ions are then detected at a detector. A signal from the detector may be sent to a computing or similar device where the m/z ratios may be stored together with their relative abundance for presentation in the format of an m/z spectrum.

In ICP-MS analysis, samples are introduced into an argon plasma as aerosol droplets. The plasma dries the aerosol, dissociates the molecules, then removes an electron from the components, thereby forming singly-charged ions, which are directed into a mass filtering device known as a mass spectrometer.

Most ICP-MS instruments include the following components: a sample introduction system composed of a nebulizer and spray chamber; an ICP torch and RF coil for generating the argon plasma that serves as the ion source; an interface that links the atmospheric pressure ICP ion source to a high vacuum mass spectrometer; a vacuum system that provides high vacuum for ion optics, a quadrupole, and a detector; a collision/reaction cell that precedes the mass spectrometer and is used to remove interferences that can degrade achievable detection limits; ion optics that guide the desired ions into the quadrupole while assuring that neutral species and photons are discarded from the ion beam; a mass spectrometer that acts as a mass filter to sort ions by their mass-to-charge ratio (m/z); a detector that counts individual ions exiting the quadrupole; and a data handling and system controller that controls aspects of instrument control and data handling for use in obtaining final concentration results.

Various suitable systems and methods exist for ionizing liquid samples containing analyte(s) of interest into a fine aerosol jet of droplets. Typically, a nebulizer gas flow is involved in this dispensing process and an impinging heater gas flow assists droplet desolvation. In the case of an ICP-MS system where the plasma is comprised of argon gas, the aerosol droplets may be exchanged with another carrier gas, such as argon, prior to introduction to the analytical instrument to avoid e.g., disturbance of the argon-based plasma.

Systems for preparing liquid samples for analysis are not configured to handle gaseous samples in gas form. When it is desired to analyze gaseous samples, separate equipment must be purchased and used. Typically, the gas sample must first be converted to a liquid sample by infusing the gas sample in water or another liquid prior to introduction to the nebulizer, etc.

Alternatively, certain systems for preparing gaseous samples typically include a gas particulation device coupled with a gas exchange device. These systems also are not interchangeable between liquid samples and gaseous samples. When the sample is in gas form and the analytical device is e.g., an ICP-MS, there is also a challenge of being able to calibrate the system as calibration standards are typically liquid.

Currently, one system is not capable of being utilized to analyze both liquid samples and gaseous samples without having to convert the gaseous samples to liquid samples.

SUMMARY

The following presents a simplified summary of various features described herein. This summary is not an extensive overview, and is not intended to identify required or critical elements or to delineate the scope of the claims. The following summary merely presents some concepts in a simplified form as an introductory prelude to the more detailed description provided below.

To overcome limitations in the prior art described above, and to overcome other limitations that will be apparent upon reading and understanding the present specification, aspects described herein are directed towards systems and methods for preparing liquid and gaseous samples for introduction into an analytical instrument.

One aspect is directed to a system configured to receive a liquid sample or a gaseous sample to be provided to an analytical device, the system comprising: a chamber comprising an outer housing having an inlet end and an outlet end; the inlet end having a gas inlet port configured to receive a gaseous sample from a gaseous sample source and a liquid inlet port configured to receive a liquid sample from a liquid sample source and form a liquid sample aerosol from the liquid sample; the outlet end having an outlet port coupled to a gas exchange device so that the gaseous sample or liquid sample will flow through the outlet port to the gas exchange device; an interior chamber extending between the inlet end and the outlet end, the interior chamber connected to the liquid inlet port to receive the liquid sample; and the chamber being operable to selectively receive either the gaseous sample or the liquid sample.

Another aspect is directed to a system configured to receive a liquid sample or a gaseous sample to be provided to an analytical device, the system comprising: a chamber comprising an outer housing having an inlet end and an outlet end; the inlet end having a liquid inlet port configured to receive a liquid sample from a liquid sample source and form a liquid sample aerosol from the liquid sample; the outlet end having an outlet port coupled to a gas exchange device so that the liquid sample will flow through the outlet port to the gas exchange device; and an interior chamber extending between the inlet end and the outlet end, the interior chamber connected to the liquid inlet port to receive the liquid sample; and a gas inlet port connected to the gas exchange device adjacent the outlet end and configured to receive a gaseous sample from a gaseous sample source, the system being operable to selectively receive either the gaseous sample or the liquid sample.

Another aspect relates to a system for analyzing a liquid sample or gaseous sample, the system comprising: a liquid sample source and a gaseous sample source; a sample delivery device to selectively transfer the liquid sample or the gaseous sample from the respective sample source; a heated chamber coupled to the liquid sample source and the gaseous sample source, the heated chamber comprising: an inlet end having a gas inlet port configured to receive the gaseous sample and a liquid inlet port configured to receive the liquid sample; an outlet end; a mass flow controller to control flow rate of the sample gas from the gaseous sample to the gas inlet port; a gas exchange device interfaced to an outlet of the chamber, the gas exchange device having an exchange gas inlet port for receiving exchange gas and an output gas outlet port for expelling the output gas; an analytical device for receiving the output gas from the gas exchange device; and a mass flow meter interfaced between an outlet of the gas exchange device and an input to the analytical device, the mass flow meter configured to provide a flow rate of the output of the gas exchange device that is at least 98% of the flow rate of the sample gas from the gaseous sample.

A further aspect relates to a method of preparing a liquid or gaseous sample for analysis comprising: selectively transferring the liquid sample or the gaseous sample from a respective liquid sample source or gaseous sample source to a gas exchange device, wherein the liquid sample is aerosolized prior to the gas exchange device; passing the aerosolized liquid sample or gaseous sample through the gas exchange device; injecting exchange gas through the gas exchange device countercurrent to the aerosolized liquid sample or gaseous sample; passing an output of the gas exchange device to an analytical device; and monitoring the output flow rate at an interface of the gas exchange device and the analytical device.

Also disclosed are systems and methods such as a system using an analytical device for analyzing a first gas (e.g., sample gas) containing contaminants by transferring the contaminants to a second gas (exchange gas) that is compatible with the analytical device, the system comprising: (a) a gas exchange device having a membrane (e.g., nafion membrane) running therethrough, the gas exchange device further comprising: (i) a first input port for receiving the first gas, (ii) a second input port for receiving the second gas, (iii) a first output port for releasing at least the second gas from the gas exchange device, and, (iv) a second output port for releasing the second gas comprising the contaminants to the analytical device, whereby: (i) the first gas is introduced to the first input port using a first mass flow controller, (ii) the second gas is introduced to the second input port using a second mass flow controller, (iii) the first output port is connected to a pressure valve (or restrictor), and, (iv) the second output port is connected to a mass flow meter; and, (b) a microprocessor-based device for: (i) controlling the temperature of the gas exchange device (including the membrane), and, (ii) monitoring and comparing the mass flow meter and the first mass flow controller, and based on the comparison, adjusting the second mass flow controller to achieve a desired flow rate at the mass flow meter. In embodiments, the gas exchange device further comprises a third input port for receiving a third gas (e.g., makeup gas), whereby the third gas is introduced to the third input port using a third mass flow controller. In some embodiments, the microprocessor-based device controls the third mass flow controller to control the amount of the third gas entering the third input port. For example, the third gas may be a gas that was determined during calibration of the system, such that the amount of third gas entering the third input port (and controlled by the microprocessor-based device) is based on a calibration sample used on the system, such amount of the third gas based on achieving maximum sensitivity of the analytical device using a control, standard or calibration sample.

Also disclosed is a system wherein the analytical device is an inductively coupled plasma mass spectrometer, the second gas is argon, and, the third gas is nitrogen. In such an embodiment, the control may have been based on measuring an amount of Indium by the ICP-MS by a liquid control/sample.

In embodiments, the system comprises a chamber (e.g., a spray chamber) for receiving the gas sample containing contaminants or a liquid sample containing contaminants, the chamber connected between the first mass flow controller and the first input port. As such, the disclosed systems and methods related thereto can be used for analyzing either a gaseous sample containing contaminants, or a liquid sample containing contaminants. A liquid sample containing contaminants can thus be introduced to the chamber via a nebulizer, and thereafter to the first input port of the gas exchange device. In some embodiments, the chamber comprises a tube for transporting the gas sample containing contaminants from the first mass flow controller to the first input port. The tube may be, for example, a PTFE tube or some other tube suitable for transporting the gas sample containing contaminants as provided herein, and the disclosed methods and systems are not limited to a type of optional tube. In embodiments, the chamber is heated to allow for maximum efficiency of the system. In certain embodiments, the disclosed systems allow for a ratio of the exchange rate of the second gas containing the contaminants to the first gas containing the contaminants of at least 98%.

Also disclosed are methods for using an analytical device to analyze a first gas (sample gas) containing contaminants by transferring the contaminants to a second gas (exchange gas) that is compatible with the analytical device, the method comprising: (i) providing the first gas to a first input port of a gas exchange device using a first mass flow controller, (ii) providing a second gas to a second input port of the gas exchange device using a second mass flow controller, (iii) releasing at least the first gas from the gas exchange device from a first output port using a pressure valve, and, (iv) releasing the second gas containing the contaminants from a second output port of the gas exchange device to a mass flow meter, and thereafter to an analytical device, wherein a microprocessor-based device measures and compares the amount of gas at the first mass flow controller and the mass flow meter, and based on the comparison, the microprocessor-based device adjusting at least one of the pressure valve and the second mass flow controller to achieve a desired difference between the measurement at the mass flow controller (e.g., first gas containing the contaminants) and the mass flow meter (e.g., second gas containing the contaminants). As such, it is understood that the mass flow meter is measuring the amount of the second (e.g., exchange) gas (containing the contaminants) flowing towards or to the analytical instrument from the gas exchange device. As such, in embodiments, the adjusting comprises adjusting to achieve a ratio of the exchange rate of the second gas containing contaminants to the first gas containing contaminants of at least 98%.

In embodiments, the methods comprise controlling the temperature of the gas exchange device using the microprocessor-controlled device.

In some embodiments, the methods comprise providing a third gas to a third input port of the gas exchange device using a third mass flow controller; and, optionally, controlling the third mass flow controller to control the amount of the third gas entering the third input port. In some embodiments, the methods comprise controlling the amount of third gas entering the third input port based on a calibration of the system using a liquid standard.

In one embodiment of the disclosed methods, the analytical device is an inductively coupled plasma mass spectrometer, the second gas is argon, and, the third gas is nitrogen.

In at least one embodiment, the disclosed methods include providing a chamber for receiving the gas sample containing contaminants or a liquid sample containing contaminants, the chamber connected between the first mass flow controller and the first input port. In some embodiments, providing a chamber comprises providing a chamber comprising a tube for transporting the gas sample containing contaminants from the first mass flow controller to the first input port. In embodiments, the methods further comprise heating the chamber.

These and additional aspects will be appreciated with the benefit of the disclosures discussed in further detail below.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein:

FIG. 9 depicts the quantitative results of the scan of lab air of FIG. 8 using the disclosed methods and systems.

DETAILED DESCRIPTION

In the following description of the various embodiments, reference is made to the accompanying drawings identified above and which form a part hereof, and in which is shown by way of illustration various embodiments in which aspects described herein may be practiced. It is to be understood that other embodiments may be utilized and structural and functional modifications may be made without departing from the scope described herein. Various aspects are capable of other embodiments and of being practiced or being carried out in various different ways.

As a general introduction to the subject matter described in more detail below, aspects described herein are directed towards systems and methods for preparing liquid and gaseous samples for introduction into an analytical instrument.

It is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged," and similar terms, is meant to include both direct and indirect, as well as fixed or removable, mounting, connecting, coupling, positioning, and engaging by any suitable methods known to those of skill in the art.

Figure 1:
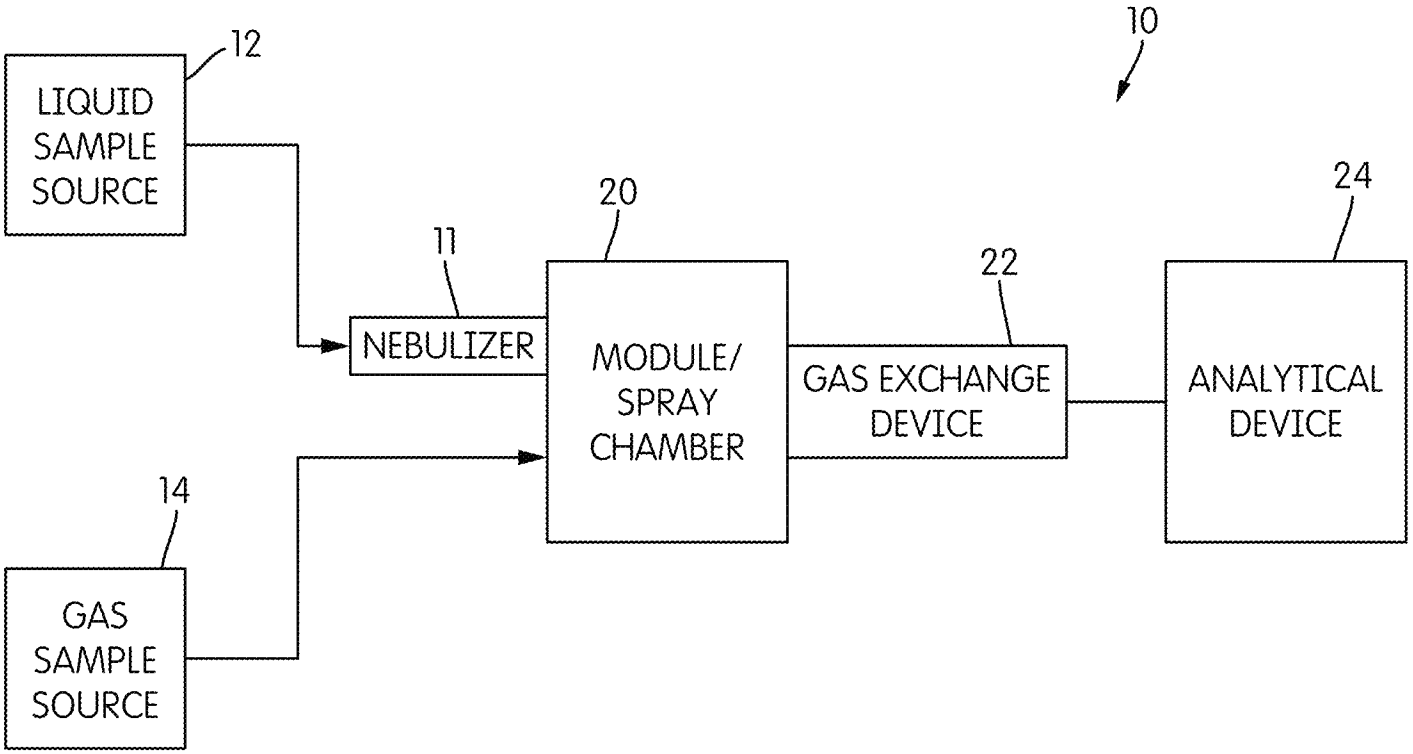
FIG. 1 is a block diagram of components that can be used with a chamber in accordance with one or more example embodiments.

An analytical instrument for testing liquid or gaseous samples may be operated with one or more pieces of equipment that prepare the samples prior to introduction to the analytical instrument. As depicted in FIG. 1, a system 10 for preparing a sample for analytical testing may include a liquid sample source 12 and a gaseous sample source 14. The liquid sample may be transported from the liquid sample source 12 to a nebulizer 11, which is coupled to a chamber 20, which in some embodiments, is a spray chamber that may be modified as disclosed herein. The gaseous sample may be transported from the gaseous sample source 14 to the chamber 20. After passing through chamber 20, the liquid sample or the gaseous sample will pass through a gas exchange device 22 that is coupled to chamber 20 before being introduced to the analytical device 24. More particularly, with this system 10, it is possible to process both liquid samples and gaseous samples through the same chamber 20, or through interchangeable chambers 20, coupled to gas exchange device 22 before introducing the sample to the analytical device 24. A separate liquid sample equipment system and a gaseous sample equipment system is not required. With system 10, it is possible to readily switch from one type (e.g., gaseous) of sample to the other (e.g, liquid), without having to utilize other equipment or reconfigure the existing system 10.

Although the elements of FIG. 1 are shown as block diagrams, the disclosure is not so limited. In particular, one or more of the boxes in FIG. 1 may be combined into a single box or the functionality performed by a single box may be divided across multiple existing or new boxes. For example, while the nebulizer 11 is visually depicted in FIG. 1 as being coupled proximate to chamber 20, FIG. 1 contemplates that the nebulizer 11 may be positioned away, or spaced apart, from chamber 20.

Figure 2:
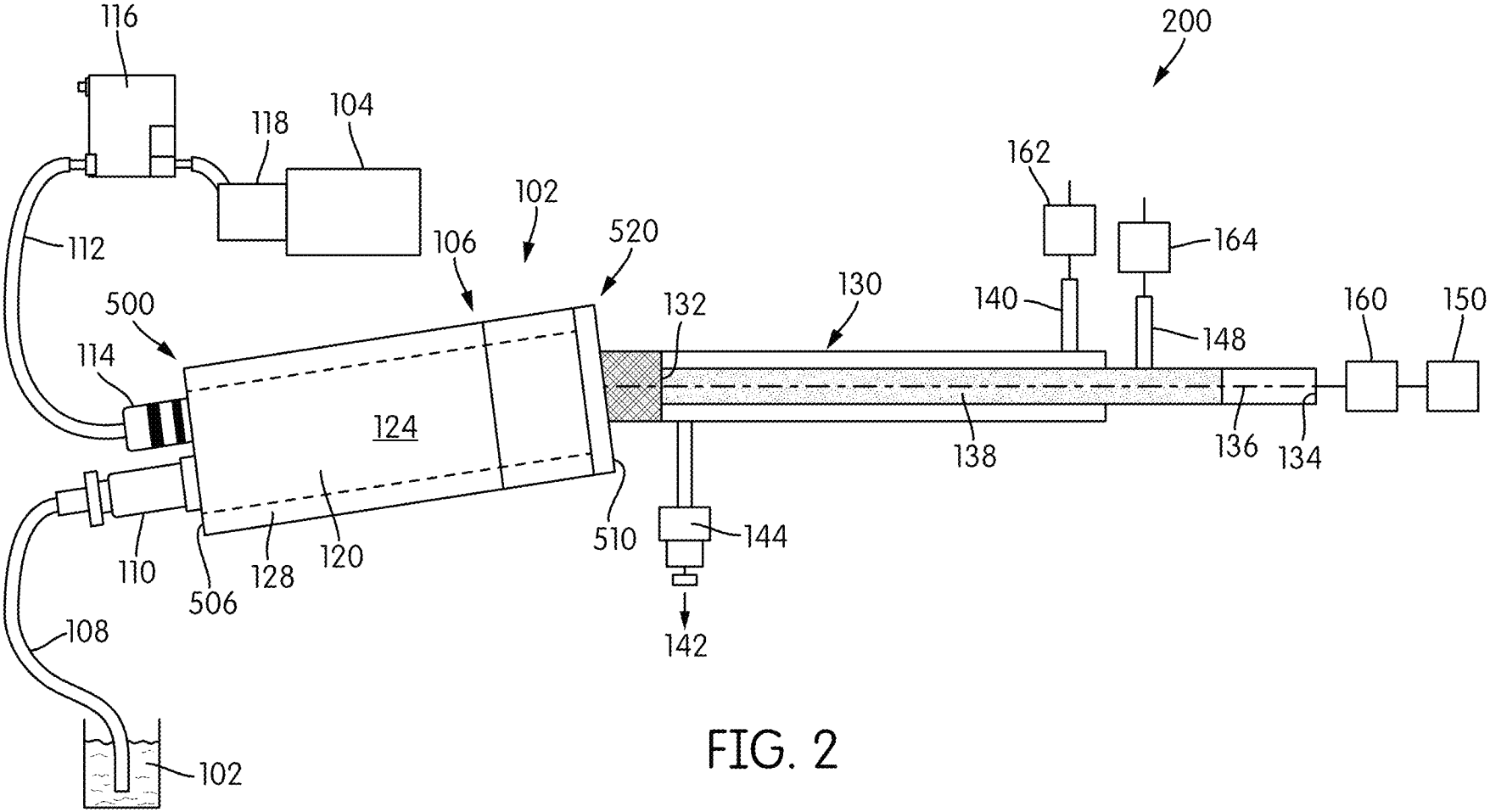
FIG. 2 depicts an illustrative arrangement for a system for introducing liquid and gaseous samples to an analytical instrument, showing a cross-sectional view of a chamber and a cross-sectional view of a gas exchange device coupled to the chamber, in accordance with one or more example embodiments.

FIG. 2 depicts an illustrative arrangement of equipment in a system 100 for preparing a liquid sample or a gaseous sample for introduction to an analytical instrument. In this example, both the liquid sample from the liquid sample source 102 and the gaseous sample from the gaseous sample source 104 are conveyed to the same chamber 106, depending on which sample is being analyzed. After flowing through chamber 106, the selected sample passes through to a gas exchange device 130, sometimes also referred to as a desolvator.

Figure 5A:
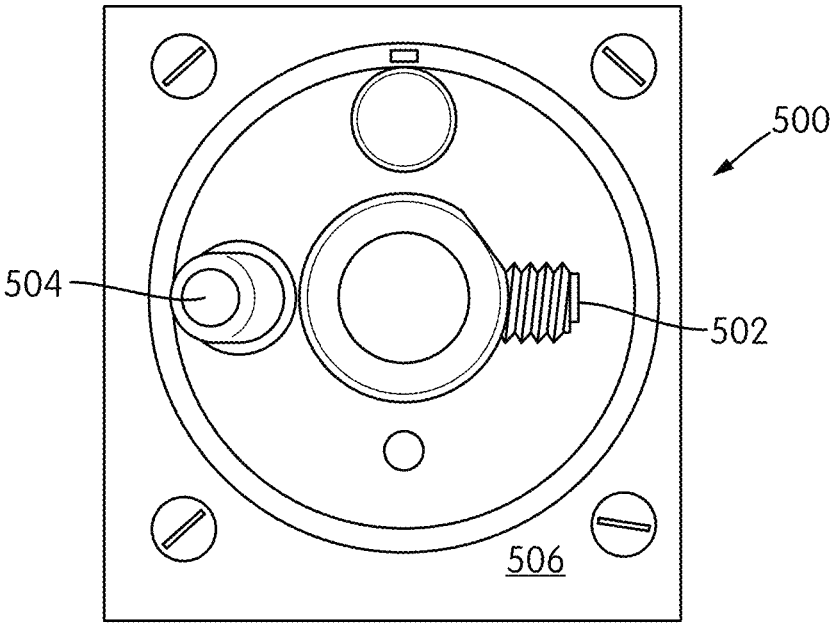
FIG. 5A depicts inlet ports on an inlet end of a chamber in accordance with one or more example embodiments.

The liquid sample may be conveyed, such as by pumping, from the liquid sample source 102 via a liquid flow conduit 108 and injected into a nebulizer 110 in which the liquid sample is nebulized into a mist or aerosol. From the nebulizer 110, the liquid sample mist is injected into the chamber 106. In certain aspects, chamber 106 may be a spray chamber such as known to one of skill in the art. With reference also to FIG. 5A, the nebulizer 110 is coupled to the inlet end 500 of the chamber 106 at a liquid inlet port 502 on the inlet wall 506. Any suitable nebulizer may be used. A variety of nebulizers, such as glass or PFA concentric nebulizers, are commercially-available from e.g., Meinhard and Elemental Scientific.

The liquid sample mist flows from the nebulizer 110 into an interior 120 of chamber 106, which is positioned in an interior portion of an outer housing 125 of the chamber 106. The interior 120 may be heated, for example to a temperature in excess of the vaporization temperature of the liquid sample. In certain embodiments, the temperature in the interior chamber 120 is maintained from about 40° C. to about 150° C., and more preferably between about 70° C. and about 110° C. The resulting aerosol droplets of the liquid sample can then be caused to flow through the interior chamber 120, typically under the influence of the pressure gradient, from the inlet end 500 of the chamber 106 to the outlet end 520 and into the gas exchange device 130.

At times, it may be desired to analyze one or more gaseous samples. Gaseous samples may be processed in system 100 as well. Gaseous samples that may be prepared using system 100 include, but are not limited to those gases listed in Table 1 and air.

TABLE 1

| | | |
|---|---|---|
| He | $CHF_3$ | $100CH_2F_2$ |
| LAr | $CF_4$ | $C_2HF_5$ |
| $LN_2$ | $C_3H_6$ | 5% $PH_3/N_2$ |
| $N_2O$ | $C_2H_4$/He | 0.1% $B_2H_6/H_2$ |
| $NF_3$ | $CH_4$/Ar | 4% $PH_3$/He |
| $NH_3$ | 5% $H_2$/4% $N_2$ | 100% $C_4F_8$ |
| | 4% $H_2/N_2$ | 100% $CH_2F_2$ |
| | 100% $C_2H_4$ | 100% $C_2HF_5$ |
| | 100% $CH_4$ | 100% $Si_2H_6$ |
| | 100% $NH_3$ | 20% $PH_3/H_2$ |
| | $BF_3$ | 10% $GeH_4$/He |
| | 1% $BCl_3/N_2$ | $105Ge_2H_6/H_2$ |
| | 20% $F_2/N_2$ | |
| | $O_2$/He | |

TABLE 1-continued

| |
|---|
| $CO_2$ |
| 1.2% He/$N_2$ |

The gaseous sample may be conveyed, such as by pumping, from the gaseous sample source 104 via a gas flow conduit 112 that is coupled to chamber 106 by connector 114. A mass flow controller 116 is used to control the flow rate of the sample gas from the gaseous sample source 104. A selector valve 118 at the gaseous sample source 104 is utilized to switch between different gaseous samples, such that a variety of gaseous samples each may ultimately be introduced to an analytical device 150 with system 100.

Gaseous sample flows into interior chamber 120 through gas inlet port 504, through the interior chamber 120, and exits through outlet port 512.

The interior chamber 120 may have generally circular cross-section and a uniform diameter along its length. In other aspects, the interior chamber 120 may have a cross-section of different shape or may not be uniform along the length of the chamber from inlet end 500 to outlet end 520.

In an embodiment, chamber 106 may be between about 10 cm and about 30 cm in length and between about 5 cm and about 10 cm in diameter, more preferably about 20 cm in length and about 7 cm in diameter. Liquid inlet port has a diameter of between about 10 mm and about 20 mm, more preferably about 0.5 mm. Depending on the desired gas flow from the outlet end 520 of chamber 106, the diameter of outlet port 512 in certain embodiments may range from about 5 mm to about 30 mm.

The interior wall 124 of the interior chamber 120 may be lined with any material that can withstand the elevated temperature in the chamber and the conditions created by the liquid sample aerosol and/or the gaseous sample. In one aspect, the surface is lined with a fluoropolymer, such as PerFluoroAlkoxy (PFA) or polytetrafluoroethylene (PTFE). As discussed below for FIGS. 3 and 4, a gas flow channel 322 may be used in the system of FIG. 2.

Optionally, a drain or similar opening (not shown) may be located along a lower portion of the inlet end 500 for removal of excess liquid sample condensate that may collect along the bottom 128 of the interior 120.

Either of the flow conduits 108, 112 may be removably connected to its respective inlet port using any known connectors. The liquid flow conduit 108 optionally may be removably connected to the nebulizer 110, with the nebulizer 110 remaining coupled to the inlet port 502 at all times. Connectors should be of a type and size to provide a secure seal to limit leakage of the liquid sample, gaseous sample or process gases and to limit pressure changes throughout the system 100.

Particularly when a gaseous sample is processed, in system 100 or any other embodiments, the gaseous sample flow rate from the sample source 104 through the interior 124 and into gas exchange device 130 is measured and controlled using known devices (e.g., mass flow meters, pressure valves/restrictors, etc.) to limit pressure changes and facilitate proper gas exchange at the enclosed membrane 138. In certain aspects, a positive pressure is maintained to move the gaseous sample through the system 100 toward and into the gas exchange device 130. The flow rate of exchange gas from the enclosed membrane 138 also may be controlled to be consistent with the flow rate of sample gas.

Figure 5B:
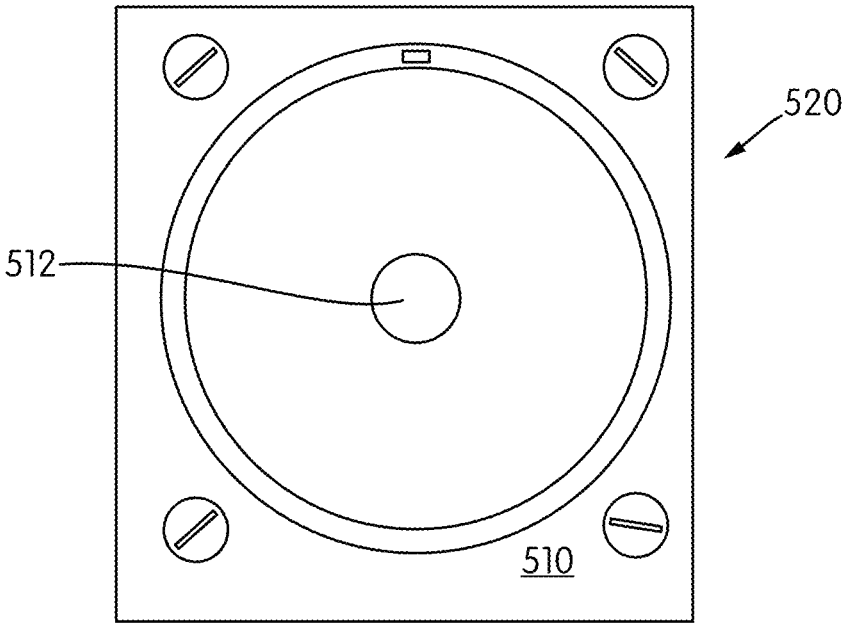
FIG. 5B depicts an outlet port on an outlet end of a chamber in accordance with one or more example embodiments.

Gas exchange device 130 has an aperture defining an inlet 132 for receiving liquid sample aerosol and gaseous sample from outlet port 512 (FIG. 5B). Outlet port 512 is connected to inlet 132 with conduits and the like such as a push fit connector, threaded connector, or other suitable connectors to provide a sealed connection between chamber 106 and gas exchange device 130. An aperture at the end of the gas exchange device opposite the inlet 132 defines an outlet 134 that is connected to the analytical device 150, such as ICP-MS or other analytical instruments/analysis systems.

Gas exchange device 130 may be formed from a generally cylindrical housing, extending along an axis 136. Other geometries are of course possible. Preferably, gas exchange device 130 includes an enclosed membrane 138 to allow for transfer of particles from the gaseous sample, or liquid sample aerosol using an exchange, to a carrier gas such as e.g., argon that is compatible with the plasma of an analytical instrument such as an ICP-MS. In certain aspects, the enclosed membrane 138 may be a fluoropolymer membrane. Gas exchange device may be heated by a heater, e.g., oven (not shown). Heater may be configured to heat the enclosed membrane 138 to a desired temperature (e.g., between about 110° C. and about 160° C. or higher). Various suitable gas exchange devices are commercially available from J-Science Lab Co., Ltd. of Japan, for example.

An exchange gas, such as argon, is caused to enter the gas exchange device 130 at inlet port 140 and to flow inside of the gas exchange device 130. A mass flow controller 162 may be positioned near the inlet port 140 to control the flow of exchange gas into the gas exchange device 130. The membrane 138 allows the exchange gas to diffuse inwardly therethrough. The membrane 138 also allows solvent vapor (with liquid samples) or gas (with gaseous samples) to diffuse outwardly therethrough but retains particles and/or dry aerosols contained in such samples within the membrane. Thus the solvent vapor or sample gas is replaced with the exchange gas within the membrane. Excess exchange gas along with the solvent vapor or the gas is then removed via outlet port 142. That is, the exchange gas flow facilitates removal of solvent vapor (with liquid samples) or sample gas (with gaseous samples) which diffuses through the enclosed membrane 138.

The sample particles that remain inside of membrane 138 are then caused to flow, typically under the influence of pressure gradient, into the analytical device 150 by way of a suitable connection.

In certain aspects, the efficiency of the gas exchange device 130 is about 80% or greater, about 90% or greater, about 95% or greater, about 97% or greater, about 98% or greater, or about 99% or greater.

If additional gas flow is needed to increase the flowrate of the gas flow to the analytical device, makeup gas may be introduced into gas exchange device 130 at makeup port 148. A mass flow controller 164 may be positioned near the makeup port 148. For example, makeup gas is nitrogen.

For example, when the analytical device is an ICP-MS with an argon plasma and the exchange gas is argon, using nitrogen as a makeup gas may be desired as the nitrogen addition will assist conduct/transfer the argon plasma energy to the dry aerosol carried by the exchange gas stream, thus promoting proper atomization/ionization of elements in the argon plasma. As discussed below, the flow rate of nitrogen is determined during the calibration of the ICP-MS, for example, and then maintained throughout the process.

Makeup gas also may be introduced at other positions in system 100 to achieve the desired control of sample gas flow and system pressure.

Flow rates for the gaseous samples may be 0 to 2 L/min, for example 0.2 to 1.8 L/min, Or 0.4 to 1.5 L/min. Exchange gas flow rate between 0 and 12 L/min. Makeup gas may be between 0 and 50 mL/min, for example, about 1 to 45 mL/min.

A mass flow meter 160 may be interfaced between the gas exchange device and the analytical device. Importantly, in regard to gaseous samples, the flow rate or pressure at the outlet 136 of the gas exchange device 130 must be close to or the same as the flow rate or pressure of the sample gas measured at the mass flow controller 116 in order to maintain a linear response of contaminants to concentration. The mass flow meter 160 may be used to measure a flow of gas to the analytical device and the ratio of this value to that set by mass flow controller 116 may be monitored. Ideally the flow of gas is at least 98%, or at least 99%, of the flow of the gaseous sample as measured by the mass flow controller of the gaseous sample.

The membrane is enclosed in a heater, and temperature is controlled between 80 and 180 C. Temperature control in conjunction with the exchange gas flow/pressure are the two fundamental parameters that ensure proper/efficient exchange. The pressure within gas exchange device 130 may be measured and controlled by a pressure gauge 144, in flow communication with the interior of the gas exchange device 138. The gas pressure should be constant from the inlet to the outlet of the gas exchange device and sufficiently high to ensure that the exchange gas is being transferred into the enclosed membrane and the sample gas is being transferred out of the enclosed membrane. Suitable pressures include 0.1 to 2 KPa, for example, 0.3 KPa The flow of gaseous sample and/or liquid sample through inlet 132 and outlet 134 may be controlled using techniques known to those of skill in the art. For example, the exchange gas, may be set at a flow rate of 1 to 15 L/min, or 1 to 12 L/min, or 3 to 10 L/min for example 8 L/min in order to obtain the desired pressure.

The mass flow controllers, 116, 162, and 164, mass flow meter 160, pressure gauge 144, and the like may be connected to a microprocessor-controlled device ("computer"), for example, to measure, monitor, and control the various inputs and flow rates. The computer may also be used to measure, monitor, and control all conditions including temperature and pressure. The computer may make adjustments based on the measured values, such as, e.g., changing flow rates, etc. In some embodiments, the computer may adjust the flow rate of the exchange gas, maintain the desired flow rate of the makeup gas, and/or control the pressure gauge and/or temperature to ensure desired conditions for maximum gas exchange are achieved.

As described, chamber 106 accommodates either liquid samples or gaseous samples, and it is possible to switch between sample sources 102, 104 with little to no interruption.

Figure 3:
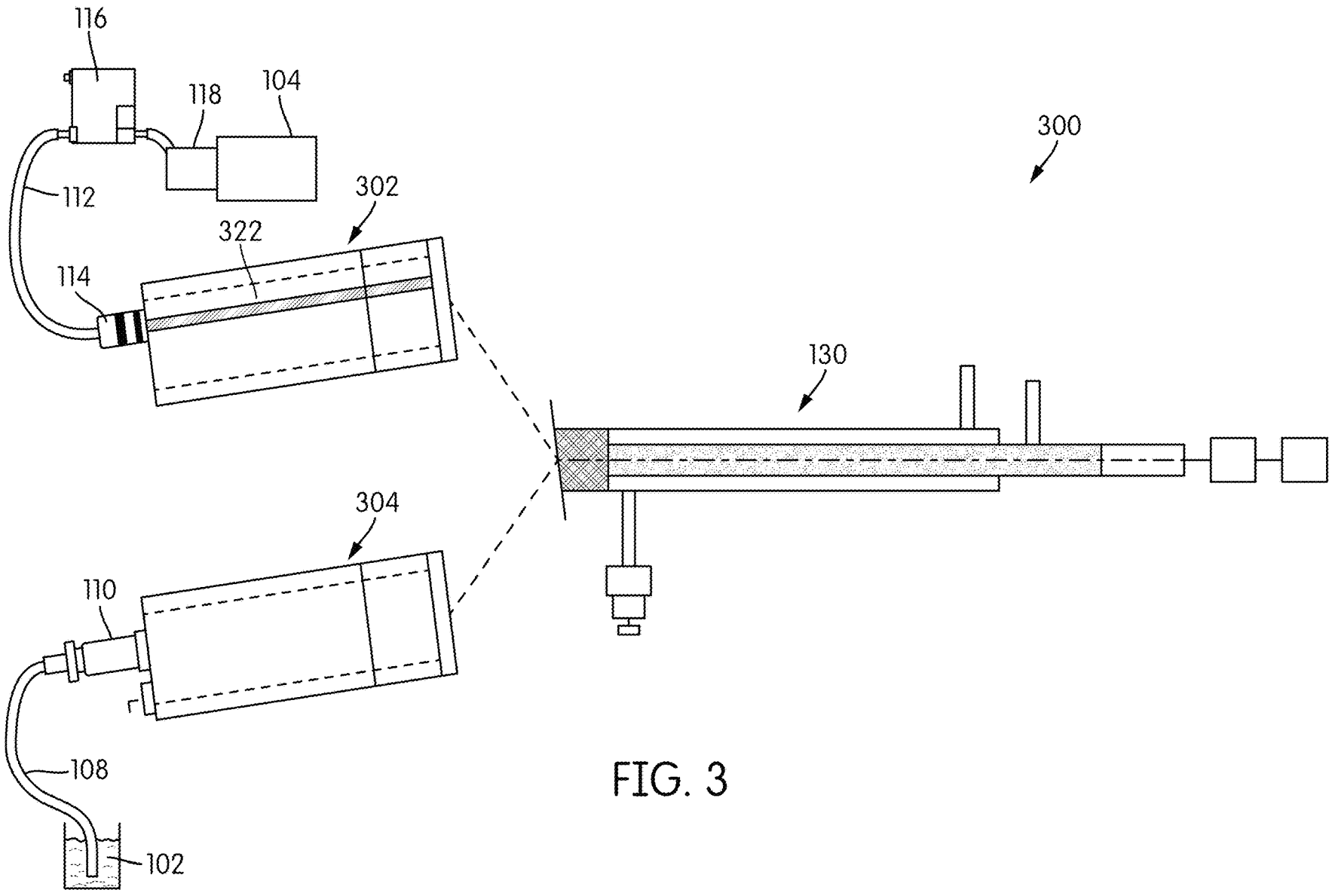
FIG. 3 depicts another illustrative arrangement for a system for introducing liquid and gaseous samples to an analytical instrument, showing cross-sectional views of two chambers and a cross-sectional view of a gas exchange device that may be coupled to one of the chambers, in accordance with one or more example embodiments.
Figure 4:
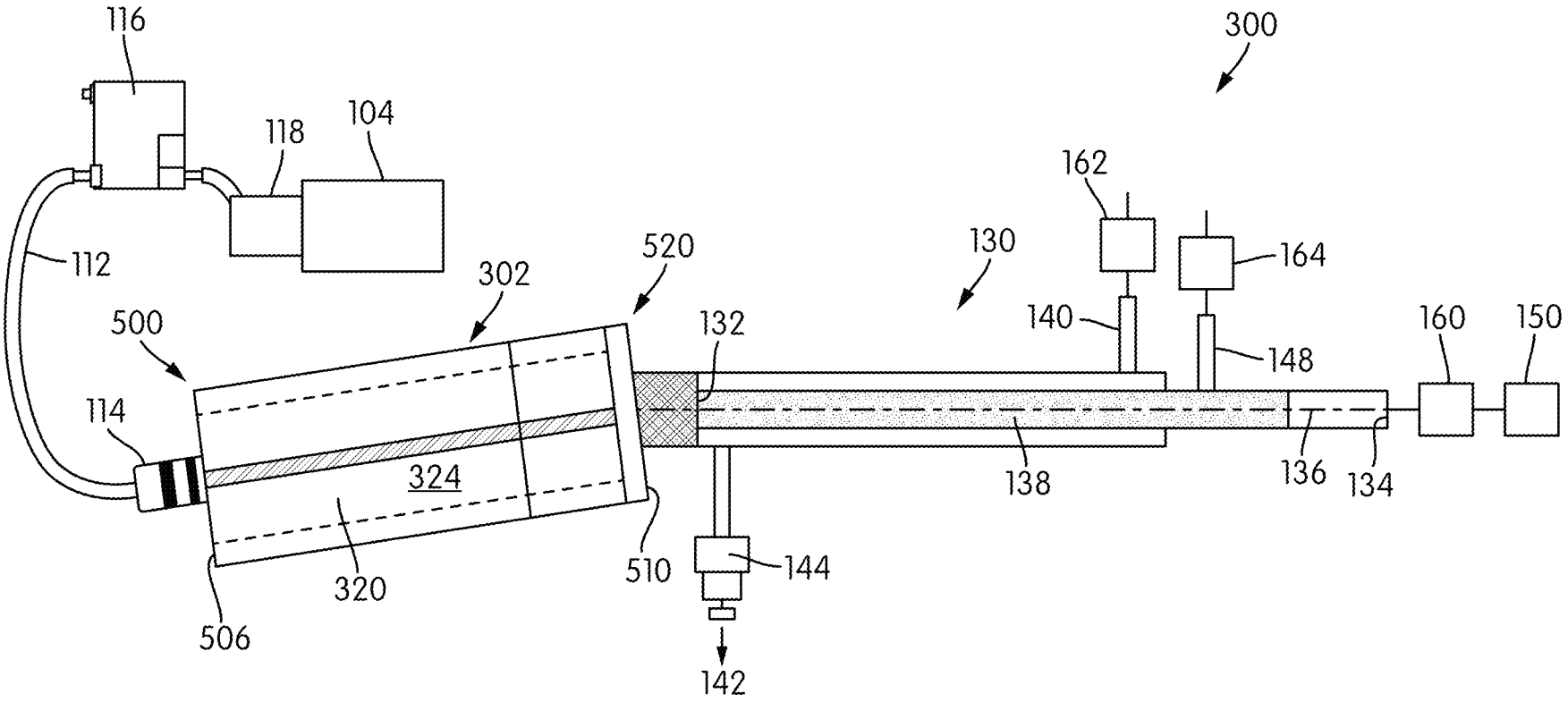
FIG. 4 depicts the system of FIG. 3 illustrating the gaseous sample chamber of FIG. 3 coupled to the gas exchange device for processing gaseous samples.

In other aspects, with reference now to FIGS. 3 and 4, system 300 may include two separate, removable chambers that can be used interchangeably in system 300. Gas chamber 302 is dedicated for use with gaseous samples and includes a gas channel 322. Liquid chamber 304 is dedicated for use with liquid samples and does not include a gas channel. Liquid chamber 304 is similar in configuration and operation as described above in regards to chamber 106 and processing of liquid sample from liquid sample source 102, except that there is no connection to gaseous sample source 104 with liquid chamber 304. When it is desired to process a gaseous sample, gas chamber 302, which is connected to gaseous sample source 104, similar to the connection as described above for system 100, is inserted into the system 300 and coupled with gas exchange device 130. When it is desired to process a liquid sample, liquid chamber 304, which is connected to a liquid sample source 102, similar to the connection as described above for system 100, is inserted into the system 300 and coupled with gas exchange device 130. In this way, either a gaseous sample or a liquid sample can be processed in system 300.

As illustrated in more detail in FIG. 4, when operably coupled to the gas exchange device 130 for processing of gaseous samples, gas chamber 302 may optionally include a gas channel 322 positioned within the interior chamber 320 and connected at one end to the gas inlet port 504 (FIG. 5A) at the inlet end 500. The gas channel transfers gas between the inlet end and outlet end of the housing without any loss of gaseous sample and without loss of pressure.

As described above in regards to system 100, mass flow controller 116 is used to control the flow rate of the sample gas from the gaseous sample source 104 via a gas flow conduit 112 that is coupled to chamber 302 by connector 114. A selector valve 118 at the gaseous sample source 104 is utilized to switch between different gaseous samples, such that a variety of gaseous samples each may be introduced to an analytical device 150 with system 300.

In gas chamber 302, gas channel 322 extends the length of the interior chamber 320 from gas inlet port 504 (FIG. 5A) at the inlet wall 506 to the outlet port 512 (FIG. 5B) at the outlet wall 510 and discharges to the inlet 132 of the gas exchange device 130. Flow of gaseous sample through chamber 302 is directed through gas channel 322. Gas channel 322 may be positioned along the axis of the chamber or may be offset toward the chamber wall. Generally, gas channel 322 will be positioned so that it extends directly from gas inlet port 504 to outlet port 512 for an unobstructed flow path. Thus, the length of the gas channel typically corresponds to the length of the chamber 302 between the inlet end 500 and the outlet end 520.

Gas channel 322 may be flexible or rigid. It may be constructed of the same material that is used to line the interior wall 324 of the interior chamber 320 (or interior chamber 120) or a different material. In one aspect, the material is selected to be inert to the gaseous samples being processed. In certain examples, the gas channel 322 may comprise PFA or PTFE tubing. The diameter and thickness of the gas channel 322 also will depend at least in part on the location and size of the gas inlet port 504 and outlet port 512. In one aspect, gas channel comprises 0.25 inch diameter PTFE tubing. Gas channel 322 is connected to ports 504, 512 using any suitable connector to provide a secure and sealed connection.

If additional support is required for the gas channel 322 during operation, other features known to one of skill in the art, such as baffles, may be included to support or secure the gas channel.

Chamber 302 is connected to gas exchange device 130, the features and operation of which are described above in regards to system 100.

When a gaseous sample is processed in system 300, the gaseous sample flow rate from the sample source 104 through the gas channel 322 and into gas exchange device 130 is measured and controlled using known techniques to limit pressure changes and facilitate proper gas exchange at the enclosed membrane 138. In certain aspects, a positive pressure is maintained to move the gaseous sample through the system 300 toward and into the gas exchange device 130. The flow rate of exchange gas from the enclosed membrane 138 also may be controlled to be consistent with the flow rate of process gas. In certain aspects, a mass flow meter 160 may be interfaced between the gas exchange device and the analytical device and tied to the mass flow controller 116. In embodiments, the mass flow meter 160 is in communication with the computer.

As discussed above for system 100, if additional gas flow is needed to maintain or adjust the pressure across the membrane 138 to obtain a desired gas exchange rate, makeup gas may be introduced into gas exchange device 130 at makeup port 148. Makeup gas may be the same gas as exchange gas or may be a different gas. The makeup gas may flow through and exit gas exchange device 130 with exchange gas. The makeup gas may also be used to increase the flowrate of the sample gas flow. Makeup gas also may be introduced at other positions in system 100 to achieve the desired control of sample gas flow and system pressure. In one example embodiment where the exchange gas is argon, the makeup gas may be nitrogen, and the amount of makeup gas is determined while calibrating the disclosed methods and systems with a liquid standard.

Figure 6:
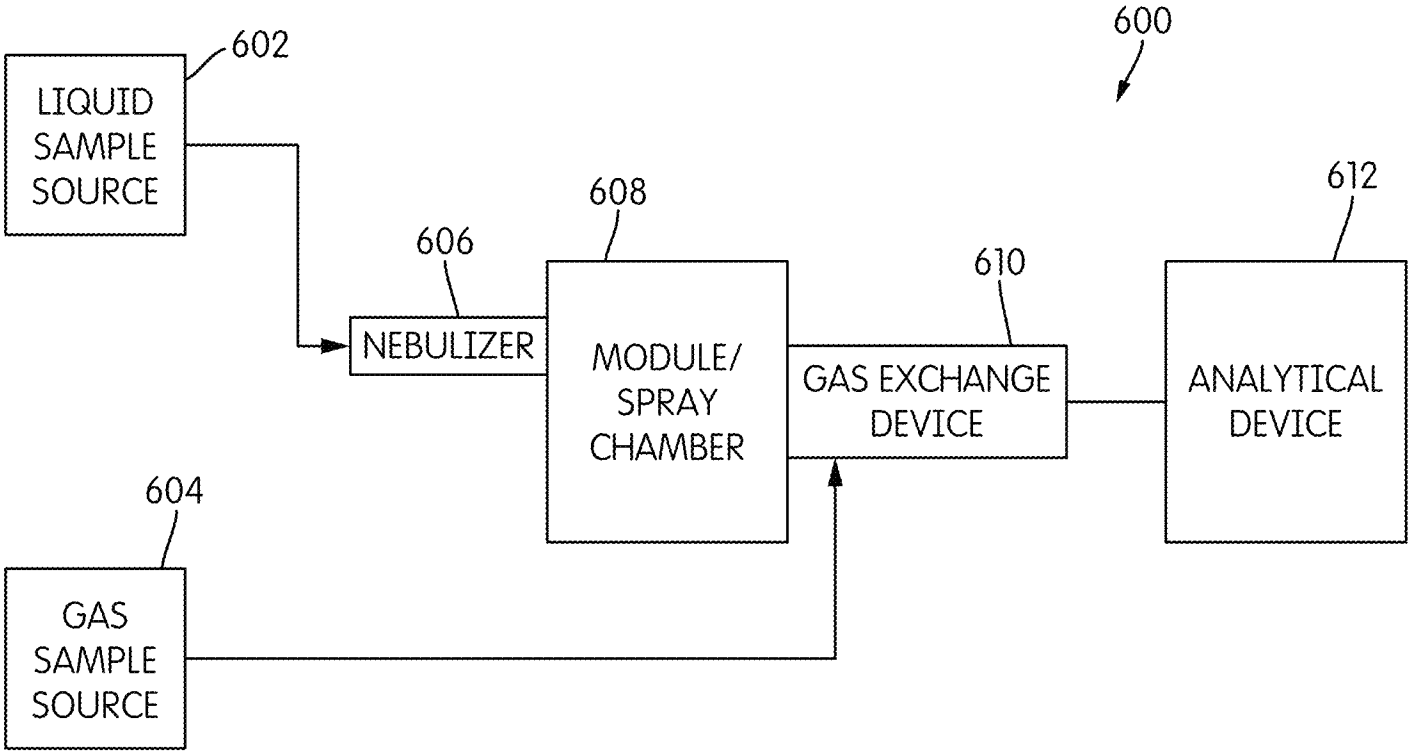
FIG. 6 is another block diagram of an alternative embodiment for introducing liquid and gas samples to a gas exchange device.

As depicted in FIG. 6, a system 600 for preparing a sample for analytical testing may include a liquid sample source 602 and a gaseous sample source 604. The liquid sample may be transported from the liquid sample source 602 to a nebulizer 606, which is coupled to a chamber 608. After passing through chamber 608, the liquid sample will pass through a gas exchange device 610 that is coupled to chamber 608 before being introduced to the analytical device 612. The gaseous sample may be transported from the gaseous sample source 604 to the gas exchange device 610, bypassing the chamber 608. More particularly, with this system 600, it is possible to process both liquid samples and gaseous samples through one chamber 608 coupled to gas exchange device 610 before introducing the sample to the analytical device 612, while still achieving desirable results. A separate liquid sample equipment system and a gaseous sample equipment system is not required. With system 600, it is possible to readily switch from one type of sample to the other, or to process a liquid sample together with a gaseous sample, without having to utilize other equipment or reconfigure the existing system 600.

Although the elements of FIG. 6 are shown as block diagrams, the disclosure is not so limited. In particular, one or more of the boxes in FIG. 6 may be combined into a single box or the functionality performed by a single box may be divided across multiple existing or new boxes. For example, while the nebulizer 11 is visually depicted in FIG. 6 as being coupled proximate to chamber 608, FIG. 6 contemplates that the nebulizer 606 may be positioned away, or spaced apart, from chamber 608.

Figure 7:
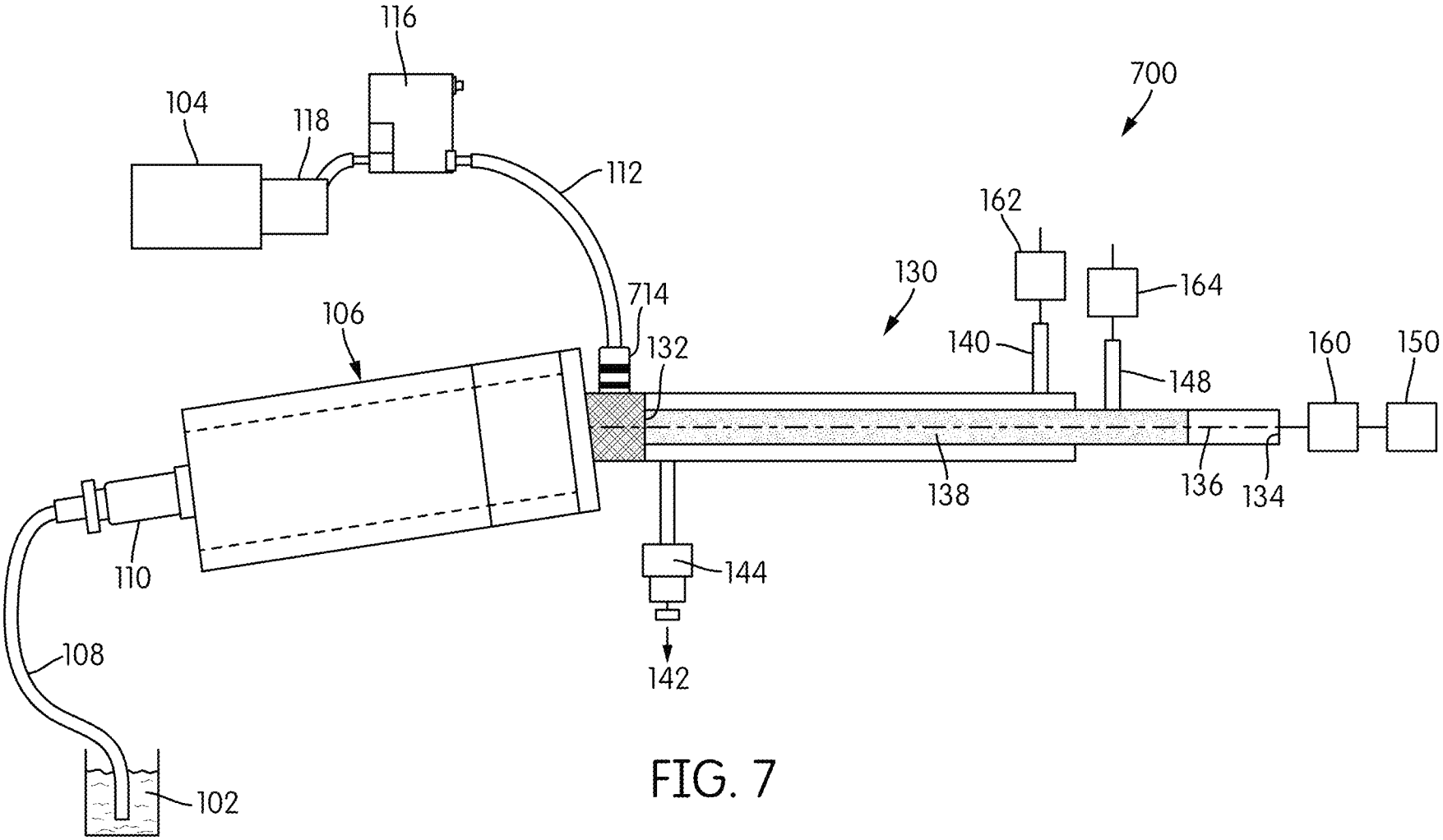
FIG. 7 depicts an illustrative arrangement for a system for introducing liquid and gaseous samples to an analytical instrument, showing a cross-sectional view of a chamber and a cross-sectional view of a gas exchange device coupled to the chamber, with liquid sample being introduced to the inlet of the chamber and gaseous sample being introduced past the outlet of the chamber, in accordance with one or more example embodiments.

FIG. 7 depicts an illustrative arrangement of equipment in a system 700 for preparing a liquid sample or a gaseous sample for introduction to an analytical instrument. In system 700, gaseous sample is conveyed from gaseous sample source 104 via gas flow conduit 112 to the inlet 132 of gas exchange device 130 where it is coupled by connector 714. A mass flow controller 116 is used to control the flow rate of the sample gas from the gaseous sample source 104. A selector valve 118 at the gaseous sample source 104 is utilized to switch between different gaseous samples, such that a variety of gaseous samples each may be introduced to an analytical device 150 with system 300. Liquid sample is conveyed from liquid sample source 102 via liquid flow conduit 108 to nebulizer 110 and chamber 106. In this arrangement, the gaseous sample bypasses the chamber 106. Liquid sample may be processed in chamber 106, as described above, before passing to inlet 132.

Gas flow conduit 112 is connected to gas exchange device 130 using any suitable connector 714, such as a swage type.

In one aspect, a "T" connection between chamber 106 and gas exchange device 130 may be used to couple gas flow conduit 112 to chamber 106 and inlet 132 of gas exchange device 130.

With system 700, gaseous sample from gaseous sample source 104 is independently introduced to analytical device 150. Liquid sample is conveyed through chamber 106, as described above in regards to system 100.

As with other systems described herein, the gaseous sample flow rate from the sample source 104 into gas exchange device 130 is measured and controlled using known devices (e.g., mass flow meters, pressure gauges, etc.) to limit pressure changes and facilitate proper gas exchange at the enclosed membrane 138. In certain aspects, a positive pressure is maintained to move the gaseous sample through the system 700 toward and into the gas exchange device 130. The flow rate of exchange gas from the enclosed membrane 138 also may be controlled to be consistent with the flow rate of process gas during calibration. In certain aspects, a mass flow meter 160 may be interfaced between the gas exchange device and the analytical device and tied to the mass flow controller 116.

As discussed above for system 100, if additional gas flow is needed to maintain or adjust the pressure across the membrane 138 to obtain a desired gas exchange rate, makeup gas may be introduced into gas exchange device 130 at makeup port 148. Makeup gas may be the same gas as exchange gas or may be a different gas. The makeup gas may flow through and exit gas exchange device 130 with exchange gas. The makeup gas may also be used to increase the flowrate of the sample gas flow. Makeup gas also may be introduced at other positions in system 100 to achieve the desired control of sample gas flow and system pressure.

A mass flow meter 160 may be interfaced between the gas exchange device and the analytical device. As previously discussed for system 100, in regard to gaseous samples, the flow rate or pressure at the outlet 134 of the gas exchange device 130 must be close to or the same as the flow rate or pressure of the sample gas measured at the mass flow controller 116 in order to maintain a linear response of contaminants to concentration. The mass flow meter 160 may be used to measure a flow of gas to the analytical device and the ratio of this value to that set by mass flow controller 116 may be monitored e.g., by the computer. Ideally the flow of gas is at least 98%, or at least 99%, of the flow of the gaseous sample as measured by the mass flow controller of the gaseous sample.

The membrane is enclosed in a heater, and temperature is controlled between 80 and 180 C. Temperature control in conjunction with the exchange gas flow/pressure are the two fundamental parameters that ensure proper/efficient exchange. The pressure within gas exchange device 130 may be measured and controlled by a pressure gauge 144, in flow communication with the interior of the gas exchange device 138. The gas pressure should be constant from the inlet to the outlet of the gas exchange device and sufficiently high to ensure that the exchange gas is being transferred into the enclosed membrane and the sample gas is being transferred out of the enclosed membrane. Suitable pressures include 0.1 to 2 KPa, for example, 0.3 KPa The flow of gaseous sample and/or liquid sample through inlet 132 and outlet 134 may be controlled using techniques known to those of skill in the art. For example, the exchange gas may be set at a flow rate of 1 to 15 L/min, or 1 to 12 L/min, or 3 to 10 L/min for example 8 L/min in order to obtain the desired pressure.

The mass flow controllers, 116, 162, and 164, mass flow meter 160, pressure gauge 144, and the like may be connected to a microprocessor-controlled device ("computer"), for example, to measure, monitor, and control the various inputs and flow rates. The computer may also be used to measure, monitor, and control all conditions including temperature and pressure. The computer may make adjustments based on the measured values, such as, e.g., changing flow rates, etc. In some embodiments, the computer may adjust the flow rate of the exchange gas, maintain the desired flow rate of the makeup gas, and/or control the pressure gauge and/or temperature to ensure desired conditions for maximum gas exchange are achieved It is to be understood that in each of the systems described herein, like features are indicated by like reference numbers and operate in a like manner in each system.

In any of the systems described herein, in operation, the gas exchange device may be initially calibrated using liquid standards according to calibration techniques known to those of skill in the art. Based on the calibration, the desired flow rates of the gaseous sample mass flow controller 116, exchange gas mass flow controller 162, and/or makeup gas (e.g., nitrogen) mass flow controller 164 may be determined. These values are generally set at the beginning of the process and then monitored. Liquid standard 102 is aspirated through the sample line 108 to the nebulizer 110, the liquid is nebulized into a linear path heated spray chamber 124 (temperature between 120 and 130° C.). Heating the spray chamber evaporates the liquid part of the aerosol facilitating its exchange in the GED 130. The dry aerosol is then carried to the ICP-MS 150. Nitrogen may be added at inlet port 148 to improve ionization in the plasma.

Once the particle-containing liquid samples and/or gaseous samples are processed in any of the systems described herein, data generated by the analytical device 150 can be analyzed by techniques known to those of skill in the art, including techniques described in U.S. Patent Application Publication No. 2015/0235833, the disclosure of which is incorporated herein in its entirety.

It is to be understood that while inductively coupled plasma and mass spectrometers were used as examples herein, any gas phase or particle sample analysis system is to be considered equivalent and may be used instead.

Figure 8:
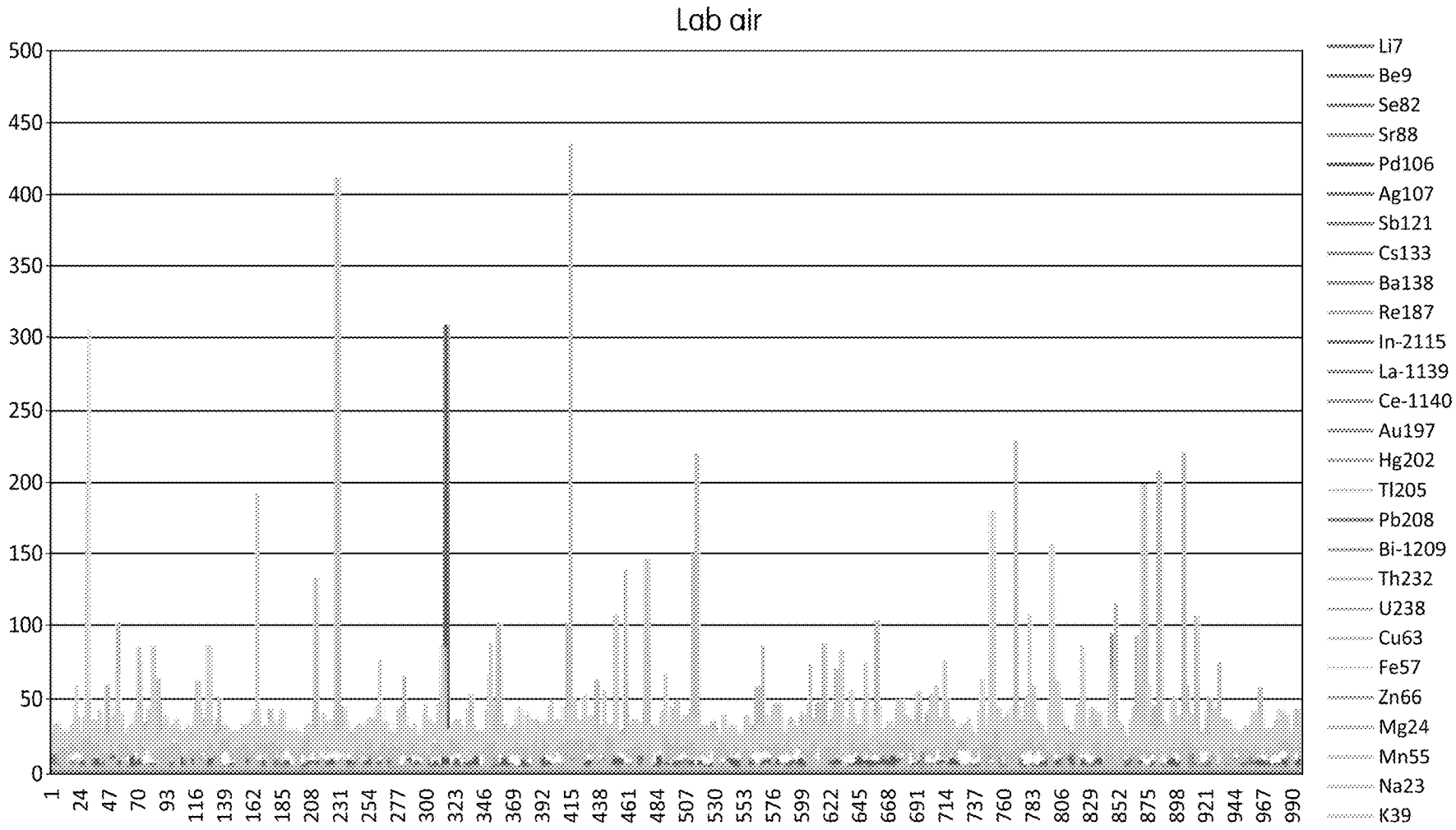
FIG. 8 depicts results of a scan of lab air using the disclosed methods and systems.

FIG. 8 depicts the ICP-MS results of a scan of lab air that utilized the disclosed methods and systems. FIG. 9 depicts the quantitative results for the results of the scan of lab air of FIG. 8. The table summarizes the following information: sample gas flow, most frequent size of analyzed particles, mean size of particle distribution, number of particles detected containing the analyzed element, particle concentration containing the analyzed element, background level intensity (dissolved intensity) and dissolved concentration (representing the background concentration level in the analyzed sample).

Figure 10:
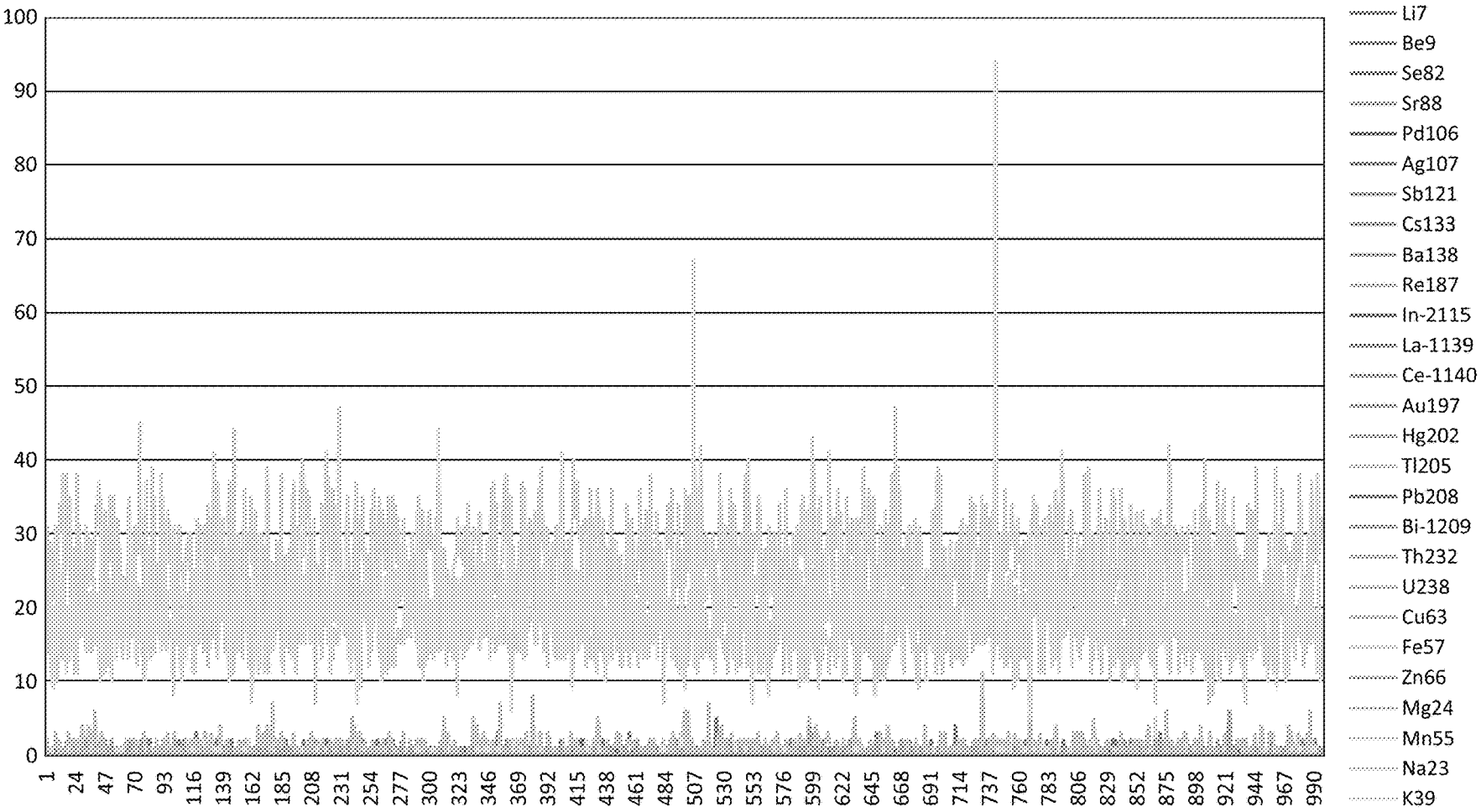
FIG. 10 depicts results of a scan of compressed air using the disclosed methods and systems.

Compressed air was connected to gas sample mass flow controller 116 in accordance with the disclosed methods and systems. The air matrix (78.09% nitrogen, 20.95% oxygen, 0.93% argon, 0.04% carbon dioxide) was exchanged with argon and the impurities in the compressed air were analyzed by the ICP-MS. FIG. 10 depicts the results of a scan of compressed air for 30+ elements.

Figure 11:
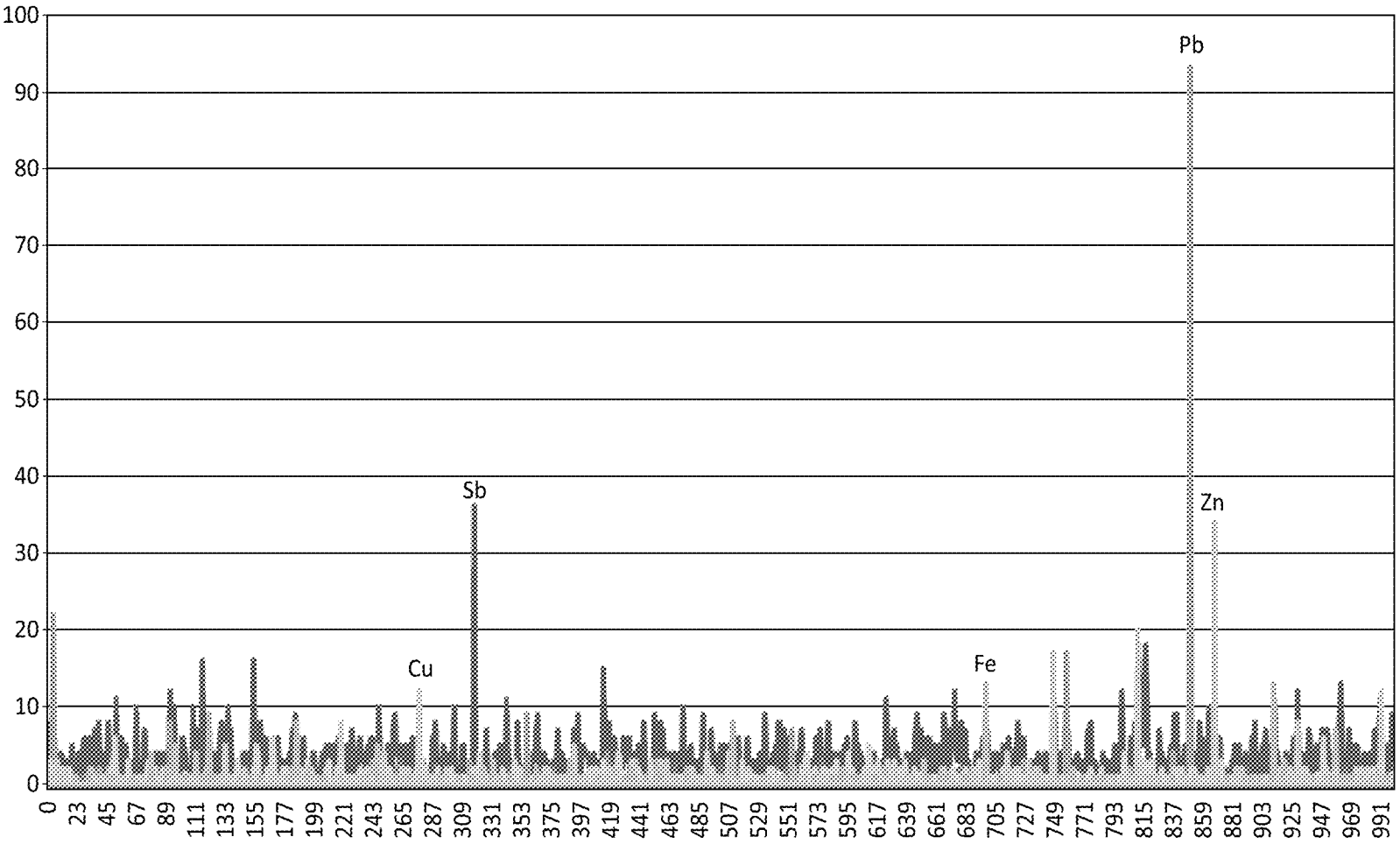
FIG. 11 depicts results of a scan of ambient air analysis using the disclosed methods and systems.

Ambient lab air was pumped using a portable air pump through the sample mass flow controller 116 for flow control. The lab air sample traveled through the heated chamber (110° C.) via a gas channel positioned within the interior chamber. A mass flow controller controlled the flow rate (1 L/min) entering the system. The resulting flow entered the gas exchange device within a heated fluoropolymer membrane (160° C.). Argon exchange gas was pumped into the gas exchange tube at a sufficient pressure (0.3 KPa) and flow rate (8 L/min.) to force Argon through the membrane. The argon replaced the air matrix (78.09% nitrogen, 20.95% oxygen, 0.93% argon, 0.04% carbon dioxide) and channeled the air contaminant into the exist of the GED 130. A make-up gas of nitrogen was added 148 prior to entering the mass flow meter and the ICP-MS. FIG. 11 depicts the results of the scan from an ICP-MS analytical instrument.

Figure 12:
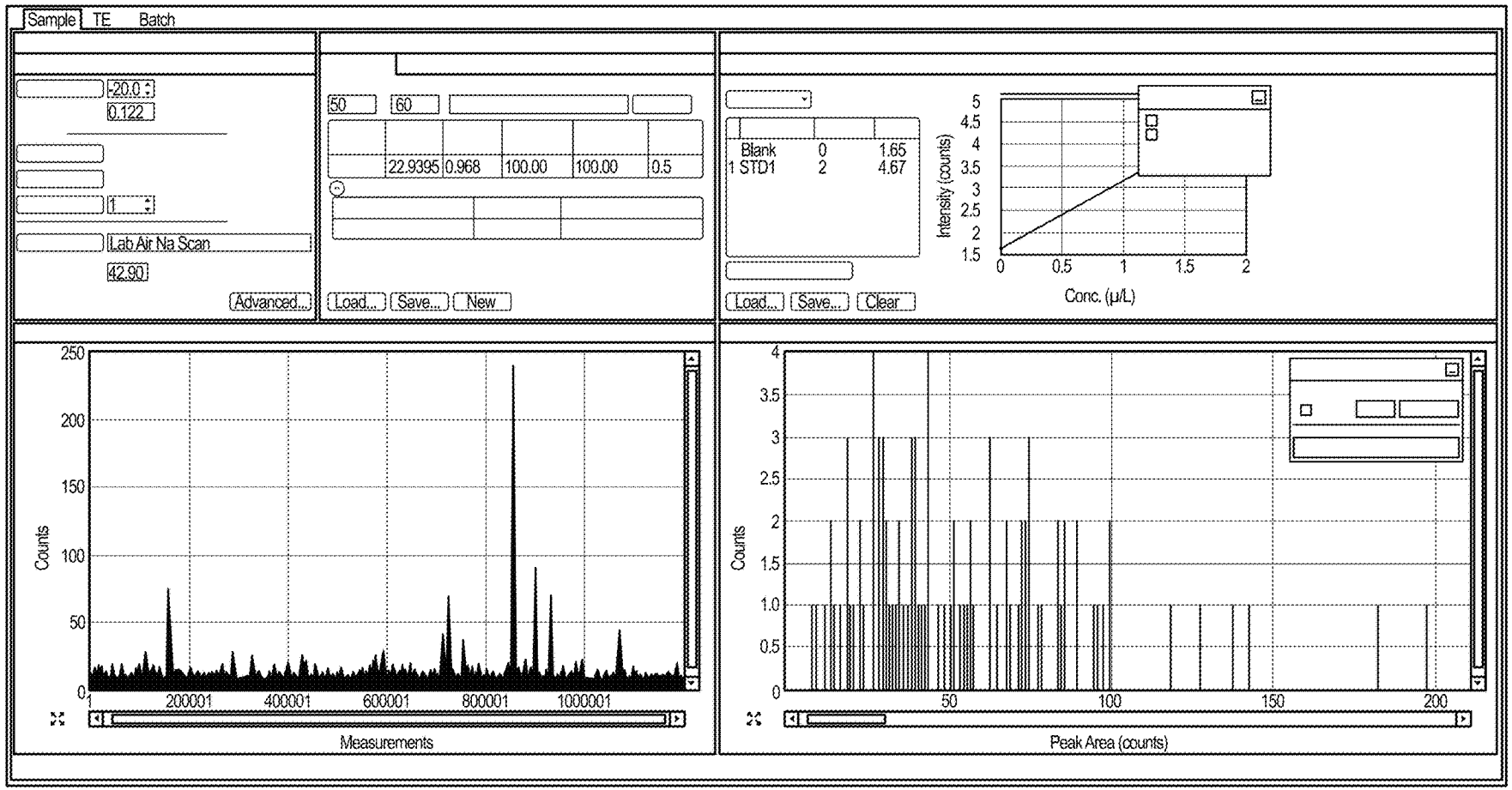
FIG. 12 depicts an example display of sodium (Na) found in lab air using the disclosed methods and systems.

FIG. 12 depicts an example display of sodium (Na) found in lab air. Similar results may be displayed for other elements, for example, but not limited to, potassium, magnesium, copper, iron, zinc, or lead.

Although the subject matter has been described in language specific to structural features and/or methodological acts, it is to be understood that the subject matter defined in the appended claims is not necessarily limited to the specific features or acts described above. Rather, the specific features and acts described above are described as example implementations of the following claims.

What is claimed is:

1. A system configured to receive a liquid sample containing particles or a gaseous sample containing particles to be provided to an analytical device, the system comprising: a chamber comprising an outer housing having an inlet end and an outlet end; the inlet end having a gas inlet port configured to receive the gaseous sample from a gaseous sample source and a liquid inlet port configured to receive the liquid sample from a liquid sample source and form a liquid sample aerosol from the liquid sample; the outlet end having an outlet port coupled to a gas exchange device so that the gaseous sample or the liquid sample aerosol will flow through the outlet port to the gas exchange device; an interior chamber extending between the inlet end and the outlet end, the interior chamber connected to the liquid inlet port to receive the liquid sample aerosol; and the chamber being operable to selectively receive either the gaseous sample or the liquid sample aerosol.

2. The system of claim 1, further comprising a nebulizer connected to the liquid inlet port to create the liquid sample aerosol from the liquid sample.

3. The system of claim 1, further comprising a gas flow conduit to convey the gaseous sample from the gaseous sample source to the gas inlet port.

4. The system of claim 3, further comprising a selector valve connected to the gas flow conduit, and wherein the gaseous sample source comprises different gaseous sources such that the selector valve selectively switches between the different gaseous sources.

5. The system of claim 3, further comprising a mass flow controller connected configured to the gas flow conduit to control flow rate of the gaseous sample.

6. The system of claim 5, wherein the gas exchange device has an inlet aperture for receiving the liquid sample aerosol or the gaseous sample from the outlet port and an outlet aperture to convey sample particles removed from the liquid sample aerosol or the gaseous sample to the analytical device.

7. The system of claim 6, further comprising a mass flow meter interfaced between the gas exchange device and the analytical device.

8. The system of claim 7, wherein the mass flow meter is configured to provide a flow of gas to the analytical device that is at least 98% of the flow of the gaseous sample as measured by the mass flow controller.

9. The system of claim 1, further comprising a gas channel extending between the inlet end and the outlet end of the outer housing and positioned within the interior chamber, the gas channel connected to the gas inlet port to allow the gaseous sample to enter and pass through the gas channel.

10. The system of claim 1, wherein the gas exchange device comprises a cylindrical housing, extending along an axis, and enclosing a membrane for removal and transfer of particles from the gaseous sample or the liquid sample aerosol, and an exchange gas inlet port and an exchange gas outlet port.

11. A system configured to receive a liquid sample containing particles or a gaseous sample containing particles to be provided to an analytical device, the system comprising: a chamber comprising an outer housing having an inlet end and an outlet end; the inlet end having a liquid inlet port configured to receive the liquid sample from a liquid sample source and form a liquid sample aerosol from the liquid sample; the outlet end having an outlet port coupled to a gas exchange device so that the gaseous sample or liquid sample aerosol will flow through the outlet port to the gas exchange device; and an interior chamber extending between the inlet end and the outlet end, the interior chamber connected to the liquid inlet port to receive the liquid sample aerosol; the system being operable to selectively receive either the gaseous sample or the liquid sample aerosol; and the gas exchange device has a membrane for removal and transfer of particles from the gaseous sample or liquid sample aerosol to an exchange gas.

12. The system of claim 11, further comprising a gas flow conduit to convey the gaseous sample from a gaseous sample source to the inlet end through a gas inlet port.

13. The system of claim 12, further comprising a selector valve connected to the gas flow conduit, and wherein the gaseous sample source comprises different gaseous sources such that the selector valve selectively switches between the different gaseous sources.

14. The system of claim 12, further comprising a mass flow controller connected to the gas flow conduit configured to control flow rate of the gaseous sample.

15. The system of claim 14, wherein the gas exchange device has an inlet aperture for receiving the liquid sample aerosol or the gaseous sample and an outlet aperture to convey the particles removed from the liquid sample aerosol or the gaseous sample to the analytical device.

16. The system of claim 15, further comprising a mass flow meter interfaced between the gas exchange device and the analytical device.

17. The system of claim 16, wherein the mass flow meter is configured to provide a flow of gas to the analytical device that is at least 98% of the flow of the gaseous sample as measured by the mass flow controller.

18. The system of claim 15, wherein the gas exchange device further comprises an exchange gas inlet port and exchange gas outlet port.

19. A system for analyzing a liquid sample containing particles or gaseous sample containing particles, the system comprising: a liquid sample source and a gaseous sample source; a sample delivery device to selectively transfer the liquid sample from the liquid sample source or the gaseous sample from the gaseous sample source; a heated chamber coupled to the liquid sample source and the gaseous sample source, the heated chamber comprising: an inlet end having a gas inlet port configured to receive the gaseous sample and a liquid inlet port configured to receive the liquid sample; and an outlet end; a mass flow controller configured to control flow rate of a sample gas from the gaseous sample to the gas inlet port; a gas exchange device interfaced to the outlet end of the heated chamber, the gas exchange device having an exchange gas inlet port for receiving exchange gas and an output gas outlet port for expelling output gas; an analytical device for receiving the output gas from the gas exchange device; and, a mass flow meter interfaced between the output gas outlet port of the gas exchange device and an input to the analytical device, the mass flow meter configured to provide a flow rate of the output gas of the gas exchange device that is at least 98% of the flow rate of the sample gas from the gaseous sample.

20. A method of preparing a liquid sample containing particles or gaseous sample containing particles for analysis comprising: selectively transferring the liquid sample from a liquid sample source or the gaseous sample from a gaseous sample source to a gas exchange device, wherein the liquid sample is aerosolized to form an aerosolized sample prior to being transferred the gas exchange device; passing the aerosolized sample or the gaseous sample through the gas exchange device; injecting exchange gas through the gas exchange device countercurrent to the aerosolized sample or the gaseous sample; passing an output of the gas exchange device to an analytical device; and monitoring an output flow rate at an interface of the gas exchange device and the analytical device.

21. The method of claim 20, further comprising injecting makeup gas to the output of the gas exchange device to provide the output flow rate of the output of the gas exchange device that is at least 98% of the flow rate of the gaseous sample from the gaseous sample source.

22. The method of claim 20, wherein the liquid sample is transferred from the liquid sample source to the gas exchange device via a housing comprising an inlet end, an outlet end, and an interior chamber, the liquid sample passing through the interior chamber from the inlet end to the outlet end, the liquid sample being aerosolized at the inlet end.

23. The method of claim 22, wherein the gaseous sample is transferred from the gaseous sample source through the interior chamber prior to transferring to the gas exchange device.

24. The method of claim 20, further comprising controlling flow rate of the gaseous sample from the gas sample source.

* * * * *